US010030425B2

(12) United States Patent
Zasowski et al.

(10) Patent No.: US 10,030,425 B2
(45) Date of Patent: Jul. 24, 2018

(54) APPARATUS FOR PROVIDING CONSTANT TORQUE OUTPUT FROM A DOOR CLOSER OR OPERATOR

(71) Applicant: Yale Security, Inc., Monroe, NC (US)

(72) Inventors: Peter Zasowski, Yantis, TX (US); Dustin Lawhon, Lilesville, CT (US)

(73) Assignee: Yale Security Inc., New Haven, CT (US)

( * ) Notice: Subject to any disclaimer, the term of this patent is extended or adjusted under 35 U.S.C. 154(b) by 94 days.

(21) Appl. No.: 14/902,087

(22) PCT Filed: Oct. 17, 2014

(86) PCT No.: PCT/US2014/061040
§ 371 (c)(1),
(2) Date: Dec. 30, 2015

(87) PCT Pub. No.: WO2015/058035
PCT Pub. Date: Apr. 23, 2015

(65) Prior Publication Data

US 2016/0369546 A1 Dec. 22, 2016

Related U.S. Application Data

(60) Provisional application No. 61/892,674, filed on Oct. 18, 2013.

(51) Int. Cl.
*E05F 15/73* (2015.01)
*E05F 1/10* (2006.01)
*E06B 3/36* (2006.01)

(52) U.S. Cl.
CPC ..... *E05F 1/105* (2013.01); *E06B 3/36* (2013.01); *E05Y 2900/132* (2013.01)

(58) Field of Classification Search
CPC .. E05F 1/105; E05F 3/102; E06B 3/36; E05Y 2900/132
See application file for complete search history.

(56) References Cited

U.S. PATENT DOCUMENTS 1,309,056 A * 7/1919 Angell ..... E05F 3/02 16/69
1,359,144 A 11/1920 Angell
(Continued)

FOREIGN PATENT DOCUMENTS

| | | | |
|---|---|---|---|
| DE | 19500944 | A1 | 2/1996 |
| EP | 1437476 | A2 | 7/2004 |
| GB | 2008184 | A | 5/1979 |

*Primary Examiner* — Katherine W Mitchell
*Assistant Examiner* — Abe Massad
(74) *Attorney, Agent, or Firm* — DeLio, Peterson & Curcio, LLC; Peter W. Peterson

(57) ABSTRACT

A door closer or operator includes a pivoting pinion on the door closer housing for transmitting door motion, and a cam connected thereto. A connecting member extends along a spring and engages the peripheral edge of the cam. Rotation of the cam causes a change in length of the portion of the connecting member between the position tangent to the cam peripheral edge and the spring second end to expand or compress the spring, resulting in a force transmitted along a longitudinal axis of the connecting member as a result of spring deflection. The cam peripheral edge has a profile with a varying radial distance between the cam axis and the connecting member at the position tangent to the cam peripheral edge such that the radial distance is changed as the spring expands or compresses to maintain a desired constant torque about the axis of the cam and pinion.

5 Claims, 7 Drawing Sheets

(56) References Cited

U.S. PATENT DOCUMENTS

| | | | | |
|---|---|---|---|---|
| 4,653,227 | A | 3/1987 | Condon et al. | |
| 4,744,125 | A * | 5/1988 | Scheck | E05F 3/10 16/53 |
| 4,763,385 | A * | 8/1988 | Furch | E05F 3/102 16/58 |
| 4,937,914 | A * | 7/1990 | Harrison | E05F 3/102 16/62 |
| 5,943,736 | A | 8/1999 | Karkkainen et al. | |
| 7,051,403 | B2 * | 5/2006 | Homberg | E05F 3/102 16/62 |
| 8,225,458 | B1 * | 7/2012 | Hoffberg | E05F 3/102 16/49 |

* cited by examiner

APPARATUS FOR PROVIDING CONSTANT TORQUE OUTPUT FROM A DOOR CLOSER OR OPERATOR

BACKGROUND OF THE INVENTION

1. Field of the Invention

The present invention is directed to a door closer which provides even pressure to a door throughout the range of the door swing.

2. Description of Related Art

In the door closer/operator industry today there is the need for the user to feel a constant force when opening the door, especially on doors needing to meet ADA requirements. According to the prior art, one solution is a double lever arm which changes the vector angle between the arm and the door as the torque increases on the door closer/operator due to a linear spring. Another solution is the cam and roller design where the cam profile changes with the spring compression to provide a constant torque output. Prior art door closers include those of U.S. Pat. No. 4,653,227; U.S. Patent Publication No. 2013/0081227; U.S. Pat. No. 4,763,385; and U.S. Pat. No. 8,732,904. Each of these designs has disadvantages. Each has mechanical losses due to friction, the rack and pinion setup on the double lever arm closers and the cam roller on the cam/roller design. Additionally, they each require very strict tolerances for proper functionality.

SUMMARY OF THE INVENTION

Bearing in mind the problems and deficiencies of the prior art, it is therefore an object of the present invention to provide an apparatus and method for providing a constant torque to open and close a door.

It is another object of the present invention to provide a door closer and/or operator that provides a desired torque profile during the opening and closing of a door.

A further object of the invention is to provide a door closer and/or operator with constant torque output and improved maintenance and wear characteristics.

Still other objects and advantages of the invention will in part be obvious and will in part be apparent from the specification.

The above and other objects, which will be apparent to those skilled in the art, are achieved in the present invention which is directed to a door closer or operator comprising a door closer or operator housing adapted to be mounted to one of a door frame or a door and a pivoting pinion on the door closer housing for transmitting door motion between the door closer housing and the other of the door or door frame. A cam is connected to the pinion and rotatable therewith about an axis of rotation, the cam having a peripheral edge about the axis of rotation. The door closer further includes a spring having two ends, with a first end secured to the door closer housing, and a connecting member secured to the spring adjacent a second end thereof to compress the spring. The connecting member extends along the spring from the spring second end to a position beyond the spring first end where the connecting member is tangential to and engages the peripheral edge of the cam. Rotation of the cam causes a change in length of the portion of the connecting member between the position tangent to the cam peripheral edge and the spring second end to expand or compress the spring, resulting in a force transmitted along a longitudinal axis of the connecting member as a result of spring deflection. The cam peripheral edge has a profile with a varying radial distance between the cam axis and the connecting member at the position tangent to the cam peripheral edge such that the radial distance is changed as the spring expands or compresses to maintain a desired torque about the axis of the cam and the connected pinion.

The profile of the cam peripheral edge may be circular or non-circular, and have a radial distance between the cam axis and the connecting member at the position tangent to the cam peripheral edge such that the radial distance is reduced as the spring compresses or expands to provide a desired torque profile about the axis of the cam and the connected pivoting member, such as maintaining a constant torque about the axis of the cam and the connected pivoting member.

The cam may have a groove disposed along the peripheral edge of the cam and the connecting member may be a cable. The cable has a first end secured to the cam and a second end secured adjacent the spring second end, with the cable wrapping around the cam in the groove as the cam rotates to compress or expand the spring. The cam may include teeth about the peripheral edge and the connecting member may include teeth engaging the cam teeth. The cam may comprise a pinion with teeth about the peripheral edge and the connecting member may comprise a rack with teeth engaging the pinion teeth.

The spring may comprise a coil spring with a central opening and the connecting member may extend through the spring central opening from the spring second end to the cam.

The door closer or operator may have a linkage arm for pivoting the door between open and closed positions, the linkage arm having a first end attached to and sliding with respect to a track mounted to the other of the door frame or the door surface and a second end secured to the pinion and rotatable therewith. Alternatively, the door closer or operator may have a double lever arm for pivoting the door between open and closed position, the double lever arm having a first end mounted to the other of the door frame or the door surface and a second end secured to the pinion and rotatable therewith. The door closer or operator may employ no linkage arms, and the door may be secured to the pinion such that the axis of rotation of the door becomes the axis of rotation of the pinion.

In a related aspect, the present invention is directed to a method of controlling operation of a swing door. The method includes providing a door in an open or closed position interposed in a door frame and secured to the door frame by at least one hinge, and providing a door closer mounted to one of the door frame or the door surface and having the structure and features described above. The method includes urging the door into the other of the open or closed position and rotating the pinion and connected cam about the cam axis as the door moves. The rotation of the cam causes a change in length of the portion of the connecting member between the position tangent to the cam peripheral edge and the spring second end to expand or compress the spring and transmitting a force along a longitudinal axis of the connecting member as a result of degree of compression of the spring. The method includes maintaining a desired torque about the axis of the cam and the connected pinion as the door moves to the other of the open or closed position as a result of the changing radial distance of the cam axis to the cam peripheral edge at the position tangent to the connecting member as the spring expands or compresses.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-15 of the drawings in which like numerals refer to like features of the invention.

The present invention is particularly directed to a door closer or operator which provides a constant force on a door regardless of the door position. Unless otherwise indicated, the term door operator includes door closer, and vice versa. One embodiment of the closer includes a pinion, a spring, a cable attaching spring to pinion, and a variable radius pulley wherein the cable rides on a variable radius at the point where the spring force is acting as the pinion rotates during opening or closing of the door. The closer may also include a damping component that dampens the force from the user applied in the opening direction of the door, momentum of the door, backcheck, and the force from the spring or momentum of the door in closing, sweep and latch, and can be done through hydraulic control, electrical control, or other conventional methods. Certain terminology is used herein for convenience only and is not to be taken as a limitation on the embodiments described. For example, words such as "top", "bottom", "upper," "lower," "left," "right," "horizontal," "vertical," "upward," "downward," "clockwise" and "counterclockwise" merely describe the configuration shown in the figures. Indeed, the referenced components may be oriented in any direction and the terminology, therefore, should be understood as encompassing such variations unless specified otherwise. As used herein, the term "open position" for a door means a door position other than a closed position, including any position between the closed position and a fully open position as limited only by structure around the door frame, which can be up to 180 degrees from the closed position.

Figure 1:
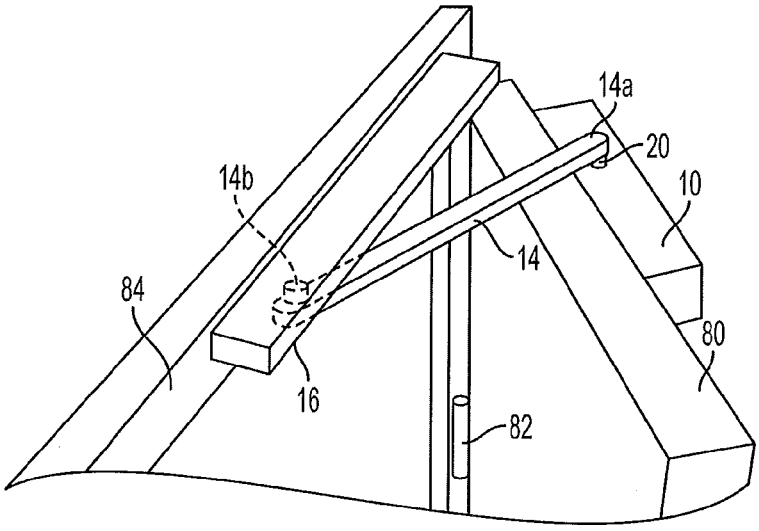
FIG. 1 is a perspective view of a first embodiment of the door closer of the present invention employing a single lever arm arrangement mounted on a door partially opened.
Figure 2:
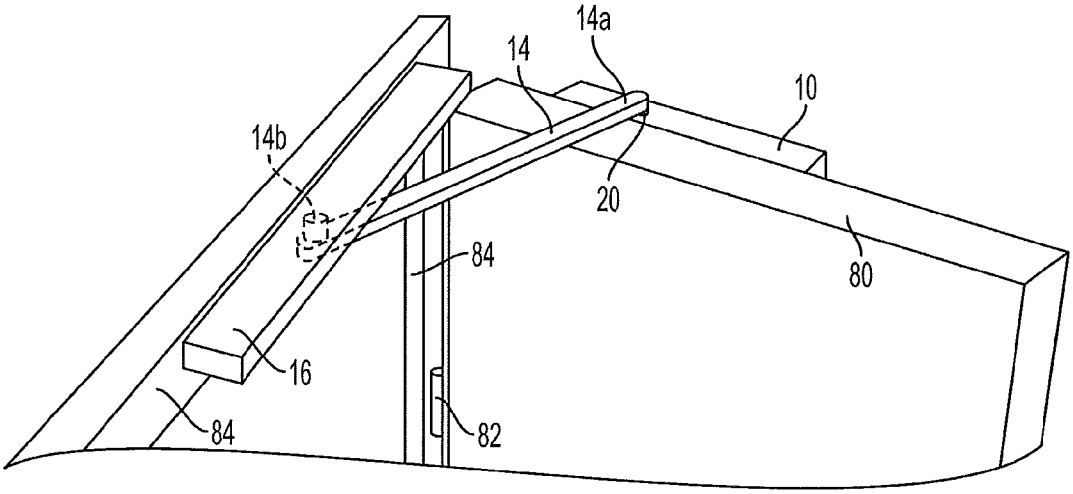
FIG. 2 is a perspective view of the door closer of FIG. 1 with the door more fully opened.
Figure 3:
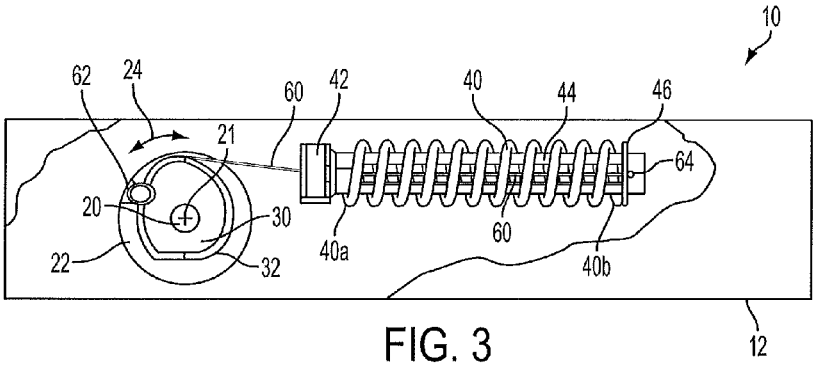
FIG. 3 is a top plan view of the interior of the door closer of FIG. 1 showing an embodiment of the spring, pinion and variable radius cam of the present invention.
Figure 4:
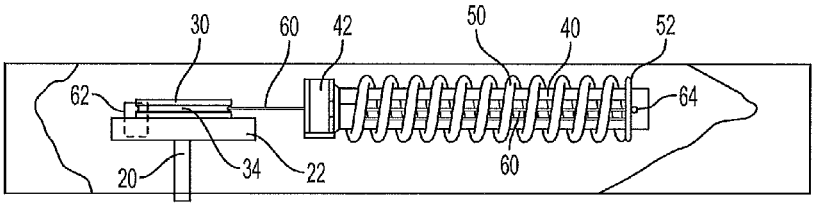
FIG. 4 is a side elevational view of the door closer interior of FIG. 3.

The attached drawings include FIGS. 1 and 2 which shows a door having an embodiment of the door closer 10 and FIGS. 3 and 4 showing the inside components of the door closer. The door closer 10 is secured to the upper portion of an otherwise conventional swing door 80 that is mounted to a door frame 84 with hinges 82 for pivoting movement of the door 80 relative to the frame 84 between a closed position and an open position. For the purpose of this description, there is shown only the upper portion of the door 80 and the door frame 84 to which the door closer is mounted. The door closer 10 includes a housing 12, a pivoting pinion 20 extending therefrom, and an operator arm assembly 14 operably coupling the door closer 10 to the door frame 84. A horizontally extending track 16 is securely mounted to an upper portion of the door frame 84 adjacent the upper edge of the door 80 when closed, and slidingly receives a roller at end **14*b* of the single operator linkage arm 14. The other end 14*a* of operator arm 14 is mounted to a pinion 20, and rotates therewith. As door 80 opens and closes, arm 14 rotates relative to door closer 10 and causes pinion 20 to rotate accordingly. As shown, door closer 10 is mounted on the pull side of door 80, i.e., the side away from frame 84, and track 16 is mounted above the door, but the door closer may be mounted on the opposite, push side of the door, and the track mounted below the upper portion of the door frame. Track 16 may also be mounted to the either side of the wall adjacent to the door frame 84, or concealed within the wall or door frame 84. Alternatively, door closer 10 may be mounted on the door frame, and track 16 mounted on the door itself. In any event, rotation of pinion 20 on door closer housing 12** transmits door motion between the door closer housing and either the door or door frame, depending where the door closer is mounted.

During the door opening, the door closer has an otherwise conventional mechanical spring to store potential energy to provide a bias to swing the door closed. This is shown in the interior view of door closer 10 in FIGS. 3 and 4, where coil spring 40 has a central opening along its longitudinal axis and extends around the outside of sleeve 44 which has an open end 42 secured within the door closer housing 12. Spring 40 is normally in an extended position, and is able to compress along its longitudinal axis. Spring end **40*a* is secured to sleeve end 42 and has an opposite end 40*b* that is moveable toward and away from end 40*a* to increase and decrease, respectively, the degree of compression of the spring, i.e., the spring deflection. Pinion 20 is mounted to rotating member 22, and both rotate about pinion axis 21 with respect to housing 12. To compress spring 40 as the door opens, a cam 30 within member 22 engages an elongated connecting member 60 attached adjacent distal spring end 40*b* to cause spring 40 to compress as pinion 20. Connecting member 60 extends through the length of sleeve 44 and coil spring 40 to a position beyond spring end 40*a* where the connecting member is tangential to and engages the peripheral edge of the cam. In the embodiment shown in FIGS. 3 and 4, connecting member 60 is a flexible, but non-stretchable steel fiber cable that has one end secured by tab 62 at a position on the periphery 32 of cam 30. The other end of the cable is secured by tab 64 within an opening in cap 46 at the end of spring 40. As the door is urged to an open position, pinion 20 and cam 30 rotate in a counter-clockwise direction of arrow 24 as shown in FIG. 3, and cable 60 is wrapped within groove 34 extending around the periphery 32 of the cam, which acts as a pulley. As cable 60 pulls to the left, movement of tab 64 at the opposite end of spring 40 causes cap 46 to compress spring 40 on sleeve 44, and imparts an increasing tensile force transmitted along the longitudinal axis of cable 60 as a result of increasing degree of compression of the spring. The length of the cable 60 engaged from the starting position, when the door is beginning to open, to the final position, when the door is fully opened, is the distance of compression of spring 44. The linear spring and pinion provide an opposing torque about the pinion axis of rotation as the door is opened and subsequently uses the potential energy stored in the spring to close the door once the user has released the door. Once the open door is released, the spring expands causing cable 60 to rotate pinion 20 and cam 30 in the opposite, clockwise direction of arrow 24 as the cable unwraps and impart force through arm 14 to close the door. Spring 40 exerts a varying force on connecting member 60, depending on spring end 40***b* position and the degree of spring compression, according to the spring constant.

In order to compensate for the spring force variation, the configuration of periphery 32 of cam 30 is non-circular, and is designed to vary according to the force imparted by spring 40 in any position of the spring. In the embodiment shown, the present invention provides a constant output torque from door closer/operator 10 which uses linear spring force to provide an output torque on pinion 20. Door closer 10 has a rigid attachment from the door to the door closer pinion 20 that causes a rotational motion on the pinion from a rotation of the door, and a linear spring 40 that is responsible for the force felt when opening the door due to the spring compression. In particular, the present invention changes the vector displacement on the pinion from the spring force as the pinion rotates and the spring compresses.

Figure 5:
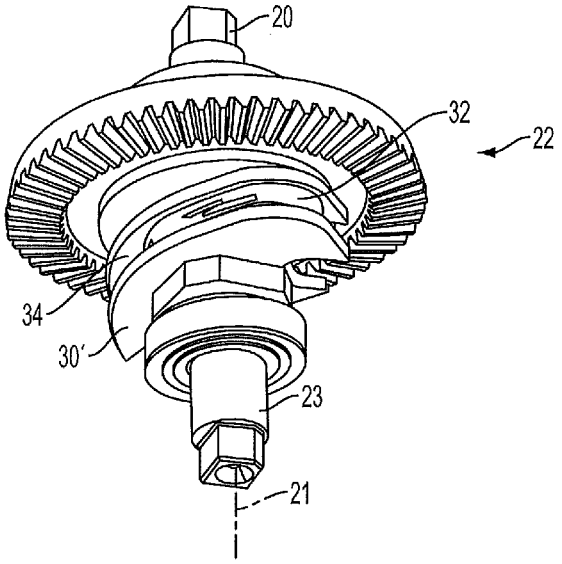
FIG. 5 is a perspective view of an embodiment of the door closer rotating member carrying the pinion and cam of the present invention.
Figure 6:
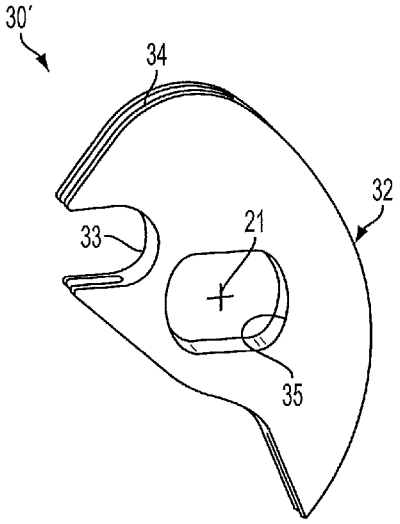
FIG. 6 is a perspective view of the cam in FIG. 5.
Figure 7:
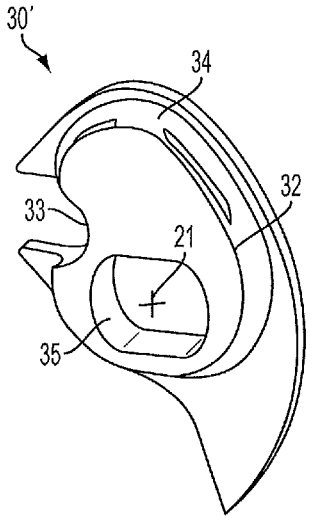
FIG. 7 is a perspective, partially cut away view of the back side of the cam of FIG. 6.

A modification of the cam is shown in FIGS. 5-7, where cam 30' has a central opening 35 for mounting on a shaft 23 of rotating member 22' (FIG. 5). Cam 30' has recess 33 in periphery 32 for receiving tab or pin 62 on the end of cable 60. The cam periphery 32 with the varying distance from cam axis 12 is along the groove 34 which receives the cable as it wraps around the cam during rotation. A bevel gear may be provided for attachment to a dampening or door motion control component of the type conventionally used, for example, an electrical motor.

A constant force value for opening and closing the door may be predetermined by the user and/or the door requirements. The constant force value is typically measured from a predetermined distance from the pivot point of the door. The desired constant force value determines a specific torque on the pivot point of the door a user wishes to achieve.

Figure 8:
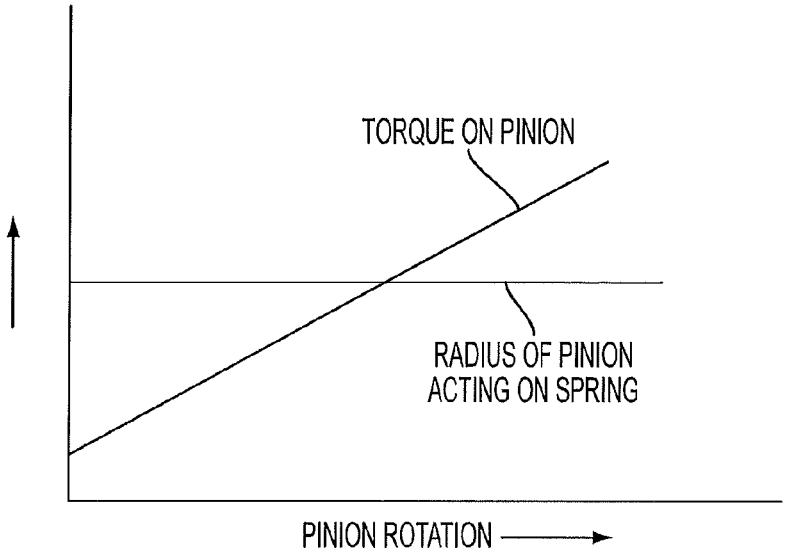
FIG. 8 is a graphical representation of the increasing closing force on a door using a constant radius cam.
Figure 9:
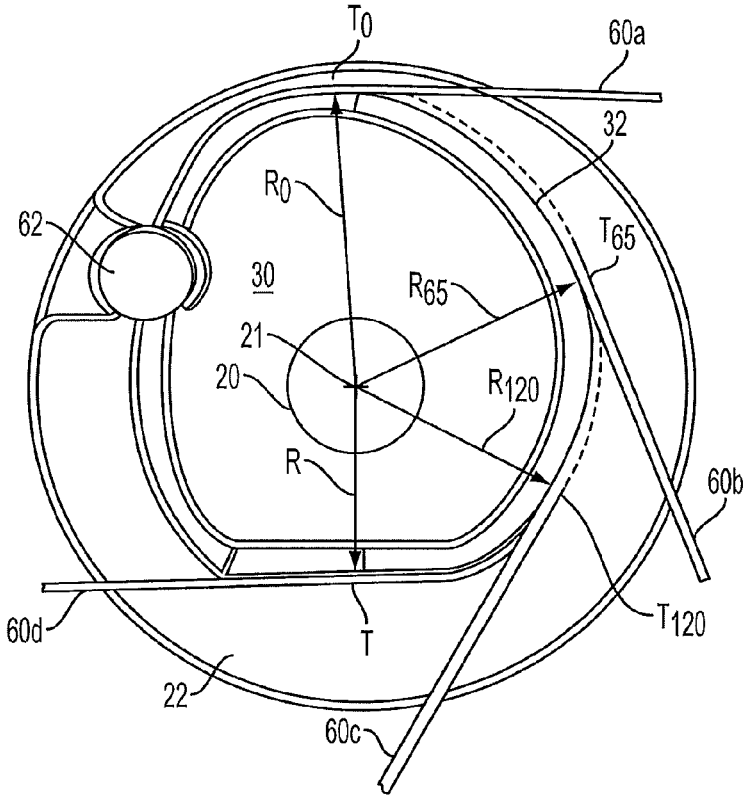
FIG. 9 is a side cut-away view of an embodiment of the variable radius cam of the present invention showing the cable in different relative positions during closing of the door.

Without the changing the cam radius, door closers using a single lever arm are subject to increasing door opening and closing force as the angle of door opening increases. A door closer comprised of a spring having a linear increase in spring force and a circular groove periphery 32 of a fixed radius about pinion 20 results in a linear increase in torque on the pinion as well, as shown in FIG. 8. In the present invention, the change in vector displacement to eliminate the increasing door opening and closing force is accomplished by using a cam profile whereby the radius on the cam changes with respect to the rotation of the pinion. More specifically, the cam profile has a varying radial distance between the cam axis of rotation and the position that the connecting member is tangent to the peripheral edge of the cam. FIG. 9 shows an example of the variable radius cam pulley 30. Tab or pin 62 on the end of cable 60 is inserted in a groove on the pulley. Cable position 60*a* represents the cable position with the door closed and at the beginning of the door opening, where the cam has a radius or radial distance R0 between cam and pinion axis 21 and point T0 at which cable 60*a* is tangent to cam peripheral edge 32. Spring 44 is compressed minimally or not at all at cable position 60*a*. As the door opens, and the pinion and pulley rotate, closer spring 40 begins to compress, thereby producing a linear increase in force on cable 60. The radius on the cam at every degree difference from the initial cable position 60*a*, at 0 degrees, is calculated such that the radius decreases with respect to the increase in spring force, yielding a constant output torque on the pinion. As cam 30 rotates, the radius changes, and the cable continues to compress the spring and generating a torque on pinion 20. The torque on pinion 20 is kept constant by varying the radius on the cam profile at each degree. As shown in FIG. 9, at cable position 60*b*, the cam has rotated 65 degrees and tangent point T65 has a radial distance of R65 between axis 21 and T65 on periphery 32. Upon further rotation of the cam to a total of 120 degrees, at cable position 60*c*, tangent point T120 has a radial distance of R120 between axis 21 and T120 on periphery 32. The final cable position 60*d*, with final radial distance R, may be at any desired tangent point T on the cam periphery. At the final cable position, the total cam circumference of the cam profile, i.e., the total peripheral distance from initial tangent point T0, is equal to the total displacement of spring 44.

After selecting the desired output torque, one can then determine the radius at each degree for any selected spring stiffness. To calculate the pulley profile necessary to keep the torque constant, first determine with the spring constant or K value of the spring, the desired output torque T and an initial radius or radial distance value between the cam axis and the connecting member at the position tangent to the cam peripheral edge, which is a limit due to design. The desired tangential force f acting on the pulley at the initial radius is then calculated. With a known K value the preload necessary to acquire this initial force is known. The profile calculation method assumes that the radius remains the same between each degree of rotation. From this assumption the distance of spring displacement may be found from the distance traveled around the cam periphery at a constant radius between degrees of cam rotation. The spring force at each degree of rotation may be determined by adding the perimeter distance traveled per degree with the preload multiplying by the K value. Once the force at each degree is known, the radius necessary at each degree to provide a constant output torque may be found, as follows:

Initial radius of pulley at 0°=r0 (fixed by pulley size limitation)

Initial force on spring=$f0$

Initial torque $T$ on pulley=$r0 \times f0$ (torque $T$ will remain constant)

Radius of pulley at 1° rotation:

$R1=T/f1$ f1 is measured by spring displacement calculated from radial distance traveled by pulley between 0° and 1°, which is approximate since the radial distance changes slightly between 0° and 1°

Radius of pulley at 2° rotation:

$$R2=T/f2$$

f2 is measured by spring displacement calculated from radial distance traveled by pulley between 1° and 2°

Radius of pulley at n° rotation:

$$Rn=T/fn$$

fn is measured by spring displacement calculated from radial distance traveled by pulley between n° and (n+1)°

Calculation of force in a spring:

$$F=K(X-X0),$$

where: F=Force

K=Spring Constant

X=Distance from Equilibrium

X0=Spring Equilibrium Position

Figure 10:
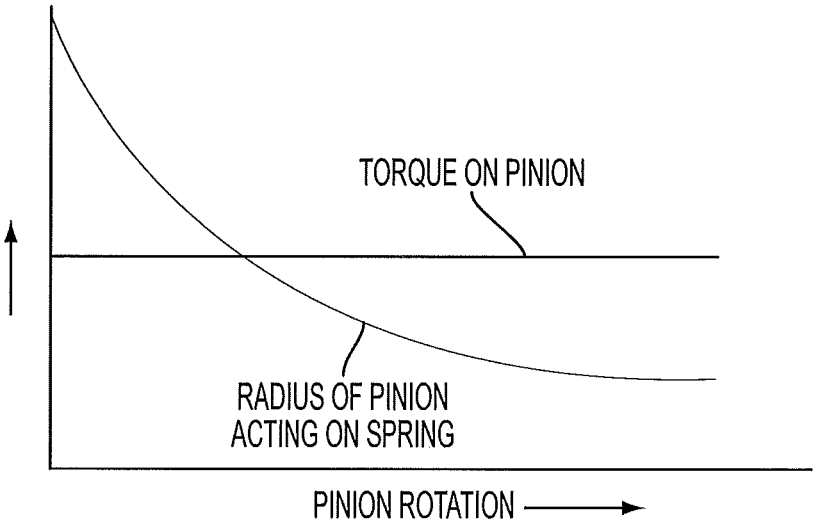
FIG. 10 is a graphical representation of the constant closing force on a door achieved using a varying radius cam according to the present invention.

Using the decreasing radius or radial distance from the cam axis to the cable tangential point as the cam rotates as determined above, the torque on the pinion, or force felt opening the door, is constant across the angle on the door opening as shown in FIG. 10.

Figure 12:
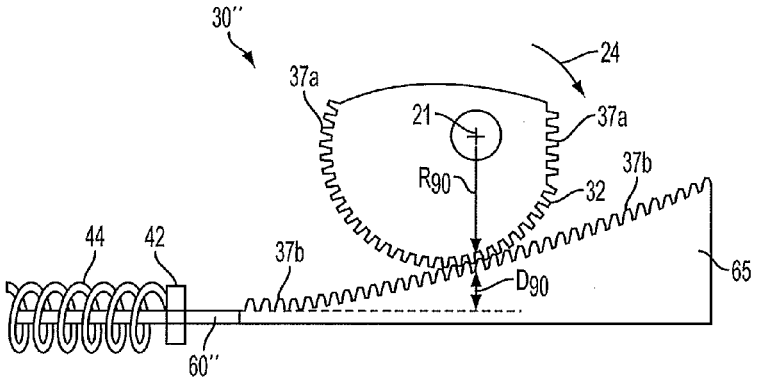
Figure 13:
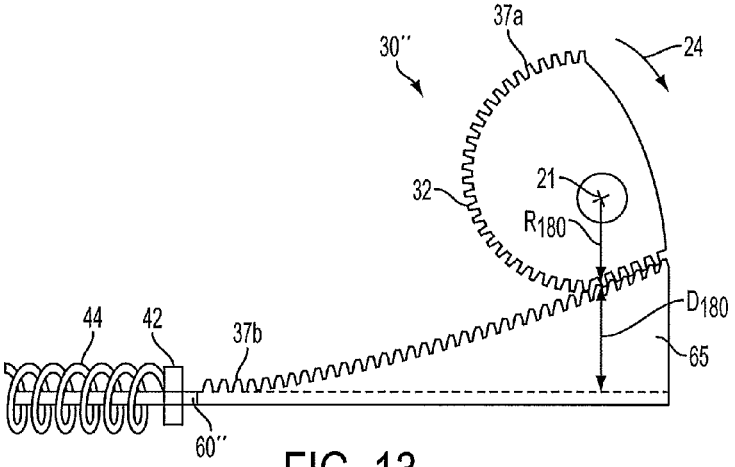

Instead of using a cable as the connecting member secured to the spring, another embodiment of the closer of the present invention includes a geared pinion, a damping component, and a geared rack. The pinion diameter and rack thickness change as the pinion gear teeth engage the rack teeth during compression of the spring. In such embodiment shown in FIGS. 11-13, the cam 30" comprises an eccentric pinion gear with teeth 37*a* about the peripheral edge 32 that has the desired profile and the connecting member 60" comprises a rack 65 at the end engaging the pinion gear with correspondingly sized teeth 37*b* along a correspondingly curved side thereof to engage the pinion teeth. As before with cam embodiment 30 and 30', cam 30" has a varying radius or radial distance R between the axis 21 and the point on the peripheral edge 32 that is tangent to or engages the teeth of rack 65 that is calculated at each degree of rotation from the starting position to produce a constant torque on the pinion as spring 44 is compressed by connecting member 60". Since rack portion 65 at the end of connecting member 60" is rigid and cannot wrap around the cam as in the cable embodiment, the thickness D of the rack at the point of contact with cam 30" changes from the initial position (FIG. 11) to the final position (FIG. 13).

Figure 11:
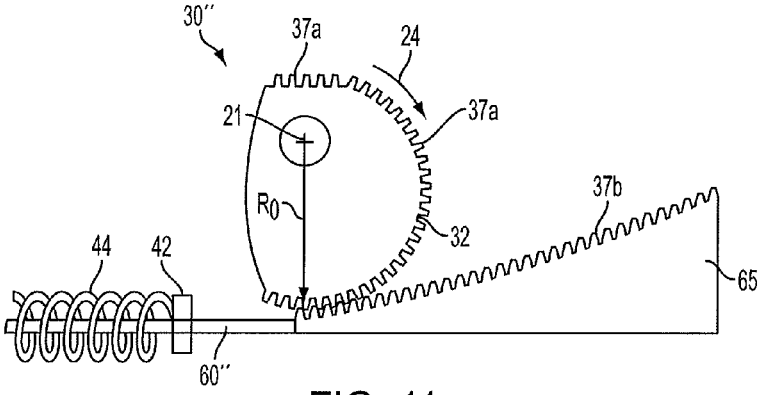
FIGS. 11-13 are side views of an embodiment of the door closer of the present invention employing a geared rack and pinion configuration for the connecting member and cam, respectively.

Operation of cam 30" is similar to that of the preceding cam embodiments, except for the meshing of the gears between the pinion gear and the rack and the inflexibility of the rack portion. In FIG. 11, at the starting position with the door closed, R0 is the radial distance between axis 21 and gear teeth 37*a* at the cam periphery 32 at the point of engaging and meshing with teeth 37*b* of rack portion 65. The position of cam 30" after rotation of 90 degrees is shown in FIG. 12, and the radial distance between the cam axis and the point of meshing with the rack teeth is R90. Because rack portion 65 is not flexible, the upper surface of the rack is inclined at an angle to have an increasing distance D above the level of engaged rack teeth 37*b* in FIG. 11, and the sum of the length of D90 and R90 is substantially equal to the length of R0. At the final position with the door fully opened, shown in FIG. 13, cam 30" rotated 180 degrees, and again the sum of cam radius R180 and rack height D180 is R0. The length of the teeth 37*b* engaged from the starting to the final position is the distance of compression of spring 44. The curved profile of rack portion 65 is complimentary to the profile of cam 30" in that the height of rack 65 is always the difference between R0 and the radial distance between the cam axis and the point of engagement with the rack. Like the previous cam embodiments, the output torque on the pinion is constant throughout the opening and closing of the door.

While the rack acts as a piston for hydraulic damping in this embodiment damping components may alternately or further include an electric motor attached to the pinion, whereby the motor controls the motion and movement of the door to act as a door operator. All components attached to the pinion, such as an electric motor, experience a constant load during operation of the door closer/operator for better control and longer life. The constant output torque can further be adjusted to meet the application by pre-compression of the linear spring.

Included in the aforementioned embodiment of the pinion and connecting member is an eccentric sprocket and flexible chain arrangement, where the cam is a sprocket with the configuration of the pinion with peripheral teeth, and the chain has rollers which serve and function as the teeth of the rack. Instead of being rigid like the rack, the connecting member chain is flexible and non-stretchable, similar to the cable. As the spring compresses, and the spring force increases, the pitch diameter on the sprocket pinion would decrease as with the aforedescribed cam configurations to maintain a constant torque on the cam and pinion.

Instead of a non-circular peripheral edge, the cam may have a circular profile with the axis of rotation offset from the center of the circle, particularly if approximating a constant torque for less than the full degree of swing of the door. As an alternative to the constant force described above, the cam profile in the door closer of the present invention may be configured to provide a varying force during the opening or closing of the door at any or all positions. One skilled in the art will appreciate that the teachings herein would enable the cam profile to be modified to provide more or less than a constant force at any position of the door movement by changing the profile to increase or decrease the torque on the door closer pinion at a desired point or range of spring position.

In operation of the door closer or operator of the present invention, any of the aforedescribed cam and connecting member embodiments may be employed. With such a door closer or operator, when starting in either the closed or open position, the user urges the door into the other of the open or closed position, whereupon the pinion and connected cam about the cam axis rotate as the door moves. The rotation of the cam causes a change in length of the portion of the connecting member between the position tangent to the cam peripheral edge and the spring second end to expand or compress the spring and transmitting a force along a longitudinal axis of the connecting member as a result of degree of compression of the spring. The result is that a desired torque is maintained about the axis of the cam and the connected pinion as the door moves to the other of the open or closed position.

The present invention can be used on any door within the limits of the closer/operator design. The shape of the cam may be determined by variables such as spring linearity, pivot locations, door resistance, desired movement of the door, and track forces whether or not the arm is connected directly to the door or doorframe.

Figure 14:
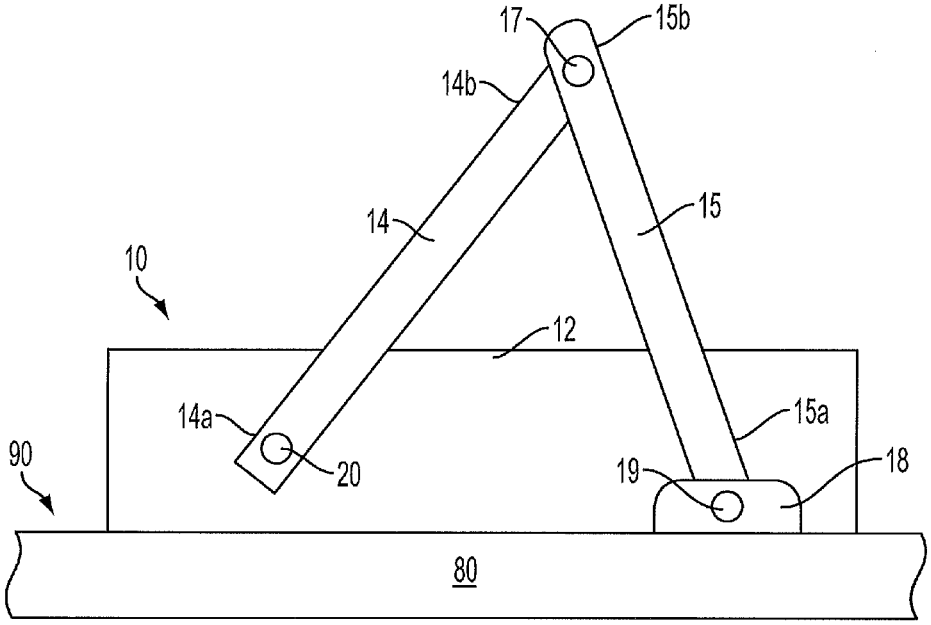
FIG. 14 is a top plan view of an embodiment of the door closer of the present invention in which a double lever arm connecting arrangement is employed.
Figure 15:
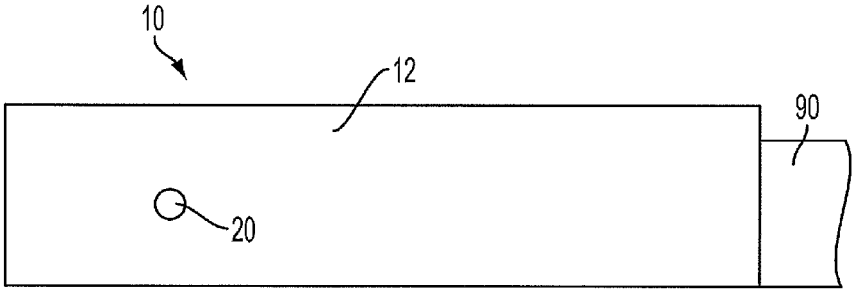
FIG. 15 is a top plan view of an embodiment of the door closer of the present invention in which the pinion serves as a hinge for the door.

Instead of having one linkage arm with sliding track configuration, the door closer of the present invention may be used in door closing systems which include a two linkage arms connected in series (also known as a double lever arm) from the door closer to the door or frame, depending where the door closer is mounted. FIG. 14 shows door closer 10 mounted on the upper face of a door 90 with a double lever arm for pivoting the door between open and closed position. The double lever arm is made up of linkage arms 14 and 15 pivoting about pin 17 at arm ends 14*b* and 15*a*. Arm 15 is connected at end 15*a* by pin 19 to a bracket 18 on door frame 80, and arm 14 is connected at end 14*a* to pinion 20 and is rotatable therewith. The opposite mounting may be used, with door closer 10 mounted to frame 80 and bracket 18 mounted on door 90. The present invention may also be used on door closers in which no linkage arms are used, where the door is secured to the pinion such that the axis of rotation of the door becomes the axis of rotation of the pinion. In FIG. 15 such an arrangement is shown in which door closer 10 is attached to door 90, and pinion 20 acts as the hinge on which the door swings.

With a constant torque output, the rigid arm and track assembly can be used on ADA required doors giving the clean look of a track setup with the performance of a double lever arm. This design can also be useful in applications where a double lever arm cannot be used due to safety issues (mental health facilities, prisons, etc.) but the user has the need for a constant force on the door. The benefits of the cable cam design over the standard roller/cam design are the less strict tolerances and the elimination of wear components such as bearings in the roller.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of controlling operation of a swing door, comprising the steps of:

providing a door in an open or closed position interposed in a door frame and secured to the door frame by at least one hinge;

providing a door closer mounted to one of the door frame or the door surface, the door closer including a housing, a pivoting pinion on the door closer housing for transmitting door motion between the door closer housing and the other of the door or door frame, a cam having a non-circular peripheral edge connected to the pinion and rotatable therewith about an axis, the cam having a groove disposed along the non-circular peripheral edge, a spring having two ends, with a first end secured to the door closer housing; and a connecting member comprising a cable, the cable having a first end secured to the cam and a second end secured to the spring adjacent a second end of the spring to compress the spring, the connecting member extending along the spring from the spring second end to a position beyond the spring first end where the connecting member is tangential to and engages the non-circular peripheral edge of the cam, the cam peripheral edge having a profile with a varying radial distance between the cam axis and the connecting member at the position tangent to the cam peripheral edge such that the radial distance is changed as the spring expands or compresses;

urging the door into the other of the open or closed position and rotating the pinion and connected cam about the cam axis as the door moves, the rotation of the cam causing the cable to wrap around the cam in the groove to compress the spring and cause a change in length of the portion of the connecting member between the position tangent to the cam peripheral edge and the spring second end to expand or compress the spring and transmitting a force along a longitudinal axis of the connecting member as a result of degree of compression of the spring, wherein the cam rotates less than 360° during movement of the door between the open and closed positions; and maintaining a desired torque about the axis of the cam and the connected pinion as the door moves to the other of the open or closed position as a result of the changing radial distance of the cam axis to the cam peripheral edge at the position tangent to the connecting member as the spring expands or compresses.

2. The method of claim 1 wherein the profile of the non-circular cam peripheral edge has a radial distance between the cam axis and the connecting member at a position tangent to the cam peripheral edge such that the radial distance is reduced as the spring compresses to maintain a constant torque about the axis of the cam and the connected pivoting member as the door moves to the other of the open or closed position.

3. The method of claim 1 further including a linkage arm for pivoting the door between open and closed positions, the linkage arm having a first end attached to and sliding with respect to a track mounted to the other of the door frame or the door surface and a second end secured to the pinion and rotatable therewith.

4. The method of claim 1 further including a double lever arm for pivoting the door between open and closed positions, the double lever arm having a first end mounted to the other of the door frame or the door surface and a second end secured to the pinion and rotatable therewith.

5. The method of claim 1 wherein the door is secured to the pinion such that the axis of rotation of the door is coaxial with the axis of rotation of the pinion.

* * * * *